United States Patent [19]

Segerstrom et al.

[11] Patent Number: 4,859,214

[45] Date of Patent: Aug. 22, 1989

[54] PROCESS FOR TREATING SYNGAS USING A GAS REVERSING CHAMBER

[75] Inventors: Clifford C. Segerstrom, Houston, Tex.; Jacob H. Stil; Adrianus J. Ooms, both of The Hague, Netherlands; Bernardus H. Mink, Degstgeest, Netherlands; Ulrich Premel, Gummersbach; Leszek Gawloski, Reichshof-Wollseifen, both of Fed. Rep. of Germany

[73] Assignee: Shell Oil Company, Houston, Tex.

[21] Appl. No.: 213,419

[22] Filed: Jun. 30, 1988

[51] Int. Cl.[4] ..... C10J 3/46; C10J 3/84

[52] U.S. Cl. ..... 48/197 R; 48/210; 48/DIG. 2; 252/373

[58] Field of Search ..... 48/197 R, 206, 209, 48/210, DIG. 2, 77; 252/373; 55/1, 80

[56] References Cited

U.S. PATENT DOCUMENTS

| | | | |
|---|---|---|---|
| 4,013,427 | 3/1977 | Geinhardt et al. | 48/DIG. 2 |
| 4,270,493 | 6/1981 | Blaskowski | 48/77 |
| 4,328,011 | 5/1982 | Geides et al. | 48/197 R |
| 4,478,608 | 10/1984 | Dorling et al. | 48/210 |
| 4,482,363 | 11/1984 | Mink | 48/210 |
| 4,610,697 | 9/1986 | Darling et al. | 48/DIG. 2 |
| 4,671,806 | 6/1987 | Stil et al. | 48/DIG. 2 |

*Primary Examiner*—Peter Kratz

[57] ABSTRACT

An apparatus and method for reversing the flow of a synthesis gas from a coal gasification reactor containing solids that tend to cause fouling of heat transfer surfaces by adjusting the volume and shape of a gas-reversal space within a chamber downstream of the reactor.

8 Claims, 2 Drawing Sheets

PROCESS FOR TREATING SYNGAS USING A GAS REVERSING CHAMBER

BACKGROUND OF THE INVENTION

A major problem with conventional systems for cooling the gas leaving the coal gasification reactor is the high concentration of molten ash in the product or synthesis gas exiting the reactor. Deposition of molten ash on heat exchanging surfaces downstream of the reactor must be avoided because the deposition would adversely affect heat transfer and pressure drop through the heat exchange section. Furthermore, since different coals produce ashes having different characteristic properties with respect to deposition on heat exchanging surfaces, designing a heat exchange section that will not foul for a range of coal types becomes more difficult.

Conventional coal gasification schemes for cooling the product gas leaving the reactor employ a radiation zone in communication with a water-containing bath whereby combustion residues are captured by the bath as disclosed in U. S. Pat. Nos. 4,310,333 and 4,520,760. 4,270,493 discloses a radiant cooler wherein molten ash particles which are entrained in the produce gas coalesce and precipitate out of the gas stream.

The present invention is directed to overcoming the problem of molten ash depositing on heat exchanging surfaces.

Applicants are not aware of any prior art which, in their judgment as persons skilled in this particular art, would anticipate or render obvious the present invention.

SUMMARY OF THE INVENTION

The primary purpose of the present invention relates to reversing the flow of a hot synthesis as containing solids that tend to cause fouling of contacting surfaces. In particular, this invention relates to reversing the flow of a hot synthesis gas from a coal gasification reactor which is laden with molten ash tending to cause fouling of heat exchanging surfaces downstream of the reactor.

Preferably, such an apparatus includes means for passing the synthesis gas from a coal gasification reactor into a gas-reversal space of a chamber; means for adjusting the volume of the gas-reversal space within the chamber; and means for removing the synthesis gas from the gas-reversal space of the chamber in a different direction from the direction of the synthesis gas entering the chamber.

Preferably, such a method includes passing the synthesis gas from a coal gasification reactor into a gas-reversal space of a chamber; adjusting the volume and shape of the gas-reversal space within the chamber; and removing the synthesis gas from the gas-reversal space of the chamber in a different direction from the direction of synthesis gas entering the chamber.

The various features of novelty which characterize the invention are pointed out with particularly in the claims forming a part of this disclosure. For a better understanding of this invention, its operating advantages and specific objects obtained by its uses, reference may be made to the accompanying drawings and descriptive matter in which there are illustrated preferred embodiments of the invention.

DESCRIPTION OF A PREFERRED EMBODIMENT

Figure 1:
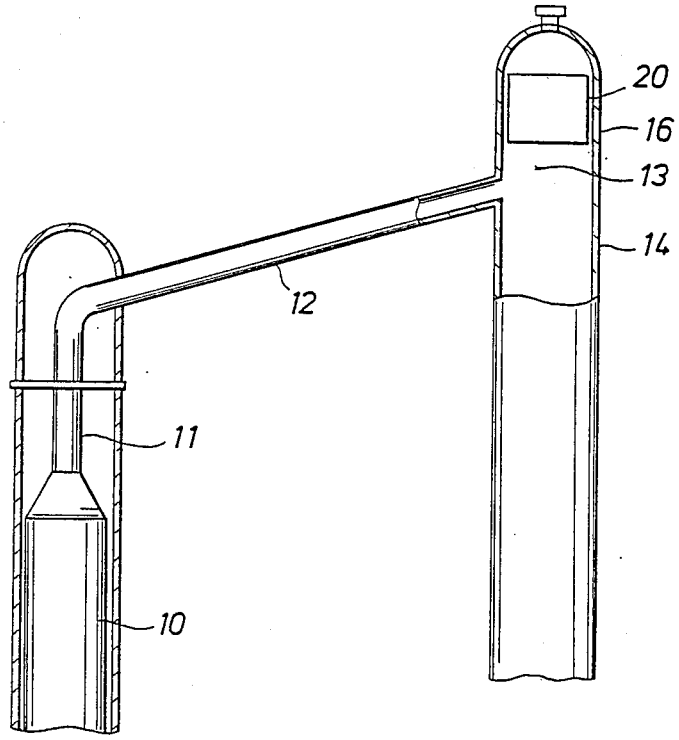
FIG. 1 illustrates a preferred embodiment of the invention above the convection cooler.

Generation of synthesis gas occurs by partially combusting carbonaceous fuel, such as coal, at relatively high temperatures in the range of 800°-2000° C. and at a pressure range of from about 1-200 bar in the presence of oxygen or oxygen-containing gases in a gasifier. Oxygencontaining gases include air, oxygen-enriched air, and oxygen optionally diluted with steam, carbon dioxide and/or nitrogen.

Gasification of coal produces a gas, known as synthesis gas, that contains mostly carbon monoxide and hydrogen. Also produced are varying quantities of other gases, such as carbon dioxide and methane, and various liquid and solid materials, such as small particles of ash and carbon commonly known and collectively defined herein as flyash or flyslag. This flyash, because it is derived from a "reducing" atmosphere, tends to be different in composition and properities from flyash normally associated with combustion boilers where a fully oxidizing atmosphere is utilized. For example, the flyash from processes for partially combusting coal may contain elemental iron, sulfides, and deposited carbon, components not normally associated with boiler flyash.

The present invention particularly relates to reversing the flow of a hot synthesis gas laden with solids, such as flyash, which tend to foul heat exchanging surfaces. Adjusting the volume of a gas-reversing chamber downstream of the quenching facility provides the capability to optimize the gas/solids flow pattern and thereby minimize the accummulation of solids with various operating conditions including different types of coal producing characteristically different types of flyash.

Additionally, avoiding deposition of solids on heat exchanging surfaces prevents problems associated with the accumulated solids subsequently falling off of the surfaces in chunks and fouling the operations of the coal gasifications process.

An advantage of the present invention is the capability of adjusting the volume and shape of the gas reversing chamber to avoid the deposition of solids on heat exchanging surfaces by keeping the solids entrained in the synthesis gas so as not to foul operations of the coal gasification process.

Although the invention is described hereinafter primarily with reference to pulverized coal and a gasifier, the method and apparatus according to the invention are also suitable for catalysts and other finely divided reactive solids which could be partially combusted, such as lignite, anthracite, bituminous, brown coal, soot, petroleum coke, and the like. Preferably, the size of solid carbonaceous fuel is such that 90 percent by weight of the fuel has a particle size smaller than No. 6 mesh (A.S.T.M.)

Having thus generally described the apparatus and method of the present invention, as well as its advantages over the art, the following is a more detailed description thereof, given in accordance with specific reference to the drawings. However, the drawings are of the process flow type in which auxiliary equipment, such as pumps, compressors, cleaning devices, etc. are not shown. All values are merely exemplary or calculated.

Referring to FIG. 1 of the drawing, an apparatus and method for reversing the flow of a synthesis gas containing solids that tend to cause fouling of heat transfer surfaces generally includes passing the synthesis gas from a coal gasification reactor 10 through a quench pipe 11 and transverse duct 12 into a space 13 within a chamber 16, hereinafter referred to as a gas-reversal chamber.

Figure 2:
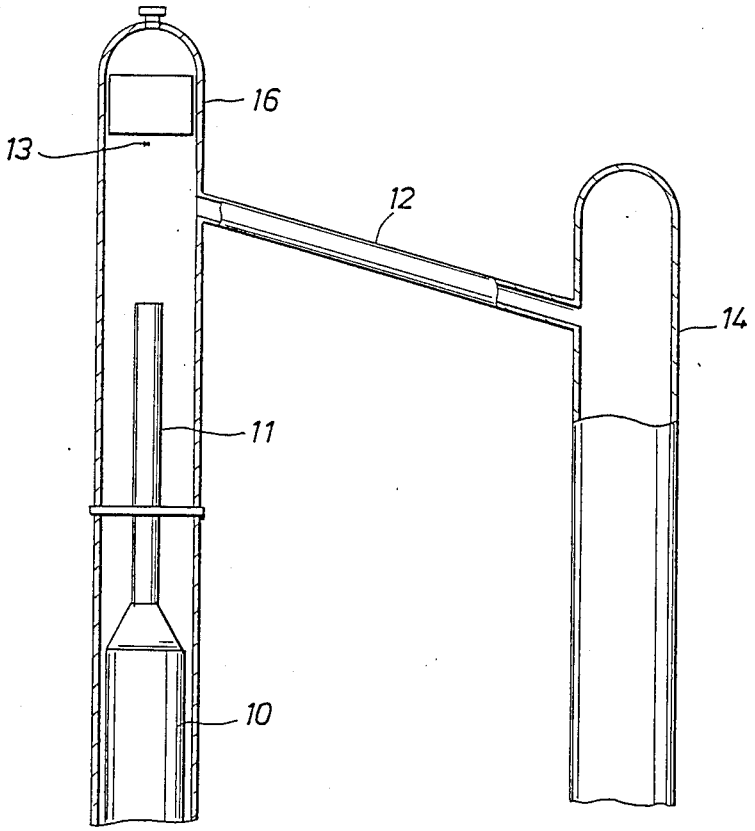
FIG. 2 illustrates an alternate embodiment of the invention.

Alternatively, the chamber 16 may be located above the quench pipe 11 as shown in FIG. 2. This configuration may be preferable to accomodate a more cost effective alignment of the equipment.

The solids or ash particles in the synthesis gas, when in a partially liquid or softened state, adhere to the contacting surfaces of the convection 14 to cause fouling of the cooler surfaces and thereby interfere with heat transfer.

The means for controlling the direction of flow of the synthesis gas within the space 13 of the gas-reversing chamber 16 include means for controlling the volume of the space 13 within the gas-reversal chamber 16. Controlling the volume is achieved by positioning a cylinder 20 within the chamber 16. The height of the cylinder 20 can be lengthened or shorteded by removing the cylinder and inserting or removing a section such as by welding or any other technique well known to the art.

Figure 3:
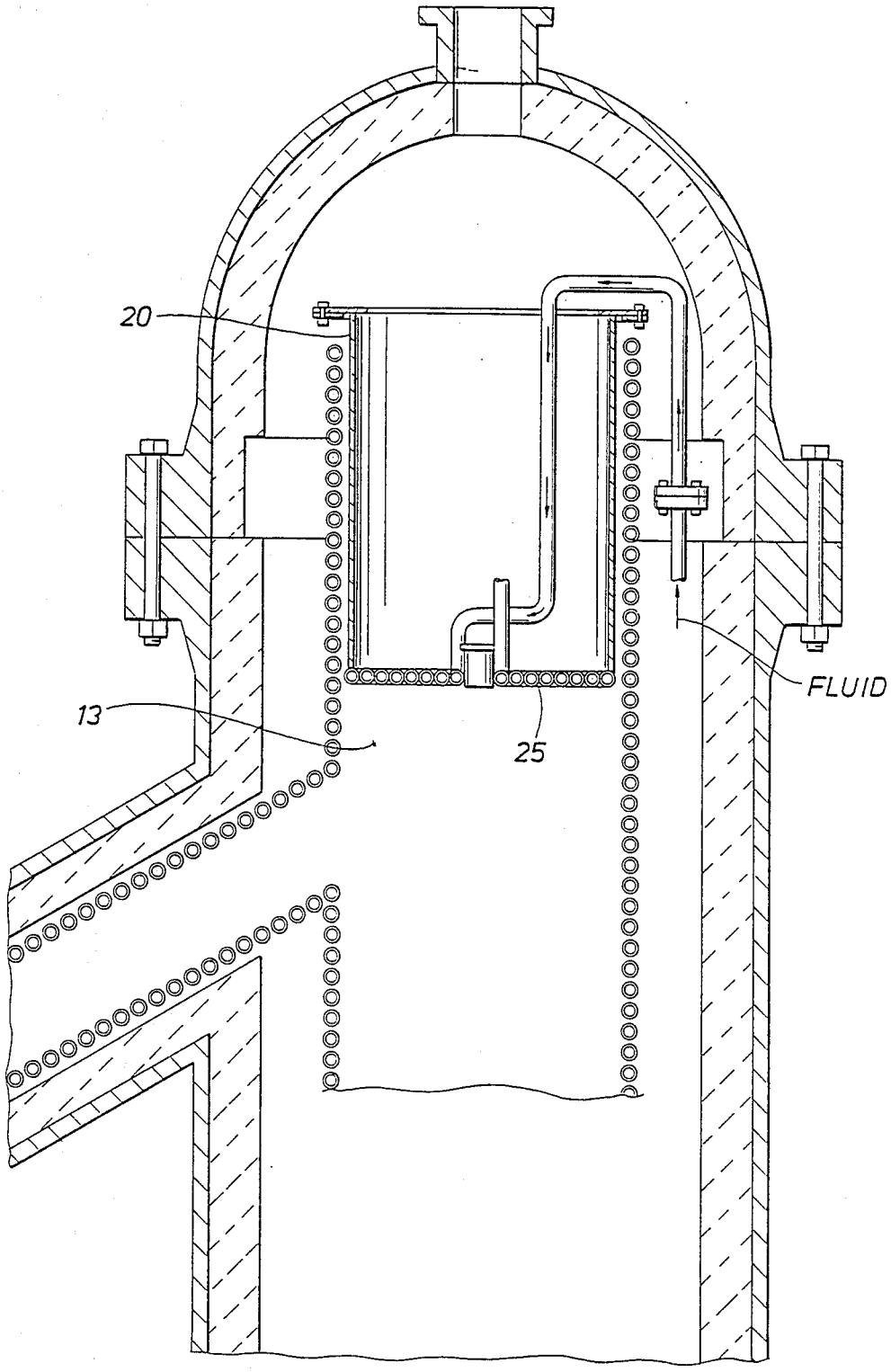
FIG. 3 illustrates a detailed cross-section of a gas-reversing chamber.

Referring to FIG. 3, the cylinder 20 and/or the cooling coils 25 can be vibrated to reduce the deposition of the ash particles on the cooling coils 25 of the cylinder 20. This vibration can be accomplished by periodic mechanical or pneumatic rapping or in any other manner well known to the art.

Although the cooling coils 25 shown at the lower end of the cylinder 20 form an imaginary horizontal plane perpendicular to the longitudinal axis of the chamber 16, the cooling coils 25 could form an imaginary plane at any angle other than perpendicular to the longitudinal axis of the chamber 16. Additionally, the cooling coils 25 could form various geometrical shapes such as a parabola, cone, etc. to achieve the desired flow pattern of the synthesis gas within the space 13 of the gas reversal chamber 16.

The foregoing description of the invention is merely intended to be explanatory thereof, and various changes in the details of the described method and apparatus may be made within the scope of the appended claims without departing from the spirit of the invention.

What is claimed is:

1. A method for reversing the flow of a synthesis gas containing solids that tend to cause fouling of heat transfer surfaces, comprising:

passing said synthesis gas from a solid carbanaceous fuel gasification reactor into a gas-reversal space within a chamber;

removing said synthesis gas from said gas-reversal space within said chamber in a different direction from the direction of synthesis gas entering said chamber;

stopping the flow of synthesis gas to said gas-reversal space;

adjusting the volume of the gas-reversal space within the chamber; and resuming the flow of synthesis gas from said gasification reactor.

2. The method of claim 1 wherein adjusting the volume includes inserting a cylinder within said gas-reversal space within said chamber.

3. The method of claim 2 including adjusting the volume and shape of said cylinder.

4. The method of claim 2 including vibrating said cylinder to remove deposited ash particles from said cylinder.

5. The method of claim 1 wherein the synthesis as is produced by partial combustion of coal, lignite or brown coal.

6. The method of claim 2 wherein the synthesis gas is produced by partial combustion of coal, lignite, or brown coal.

7. The method of claim 3 wherein the synthesis gas is produced by partial combustion of coal, lignite, or brown coal.

8. The method of claim 4 wherein the synthesis gas is produced by partial combustion of coal, lignite, or brown coal.

* * * * *